United States Patent [19]

Kraft

[11] 4,301,941

[45] Nov. 24, 1981

[54] CONTAINER CLOSURE

[75] Inventor: Donald L. Kraft, Kansas City, Mo.

[73] Assignee: Phillips Petroleum Company, Bartlesville, Okla.

[21] Appl. No.: 64,164

[22] Filed: Aug. 6, 1979

Related U.S. Application Data

[63] Continuation of Ser. No. 894,286, Apr. 7, 1978, abandoned.

[51] Int. Cl.[3] ..... B65D 41/16

[52] U.S. Cl. ..... 220/306; 206/459; 229/43; 229/5.5; 215/317

[58] Field of Search ..... 220/306, 307; 215/317; 206/459; 229/43, 48 R, 5.5

[56] References Cited

U.S. PATENT DOCUMENTS

| | | | |
|---|---|---|---|
| 495,012 | 4/1893 | Brinton | 220/352 |
| 2,614,727 | 10/1952 | Robinson | 220/306 |
| 3,093,957 | 6/1963 | Tetreault | 220/307 |
| 3,818,858 | 6/1974 | Kramer et al. | 206/459 |
| 3,851,792 | 12/1974 | Ankney | 206/509 |
| 3,880,288 | 4/1975 | Hunter | 220/306 |
| 4,141,463 | 2/1979 | Smith | 220/306 |

FOREIGN PATENT DOCUMENTS

| | | | |
|---|---|---|---|
| 7700848 | 1/1977 | Netherlands | 220/306 |

*Primary Examiner*—Joseph Man-Fu Moy

[57] ABSTRACT

A closure is provided for closing the open end of a container. The closure includes a top member and a tubular ring. The top member has a top forming portion adapted for overlying the open end of the container. An integral skirt depends from adjacent a peripheral edge of the top forming portion and is adapted to engage the rim of a container to form a seal therebetween. The skirt has lock means for releasably retaining the top forming portion in covering relation to the open end of the container. The tubular ring is mounted on the top member coaxial with and in engagement with the exterior surface of the skirt. The ring is made as a part separate from the lid and is mounted thereon when desired. The ring can have advertising indicia printed thereon and can also be used to display printed information relating to the container and/or the product contained in the container on which the closure is used.

6 Claims, 2 Drawing Figures

CONTAINER CLOSURE

This application is a continuation of copending application Ser. No. 894,286, filed Apr. 7, 1978, now abandoned.

The present invention relates to a container closure having an indicia ring.

In the use of container closures advertising indicia on the closure skirt is sometimes desirable. However, the advertising indicia is different for each customer and for each different type of product. Therefore, two steps of manufacturing a container closure are required. One, forming the container closure and, secondly, printing advertising indicia thereon. This usually necessitates waiting to manufacture a container closure until an order is received. This can pose problems in the scheduling of the manufacture of container closures because more orders may be received at one time than a plant has the capability of producing. It would therefore be advantageous to have a container closure which can be mass produced and stored and which can have advertising indicia easily added thereto at a later time to fill a customer's needs.

The present invention provides such a closure in which the main closure portion can be manufactured in mass quantities and stored. When an order for closures is received, an advertising ring mountable on the container closure can be made to fit a customer's needs. The use of a separate ring is advantageous from another standpoint in that it is desirable to make thermoformed or injection molded closures from thermoplastics which are sometimes difficult to have advertising indicia imprinted thereon. Further, closures of thermoplastic material have several advantages over paperboard closures which can be easily imprinted. The plastic closures are more durable, can have more positive lock means and can also be translucent or transparent for viewing of the product packaged in the container. Therefore, the present invention provides the advantages of both a paperboard container closure and a plastic container closure by having an easily imprinted advertising indicia ring mounted on a plastic container closure to fill a customer's needs.

An object of the present invention is to provide a multipiece container closure which pieces can be manufactured separately, wherein one of the pieces can have indicia printed thereon when an order is received from a customer. Another object of the present invention is to provide a container closure which can have a plastic closure portion which is either translucent or transparent for viewing of the contents of the container. Another object of the present invention is to provide a container closure which has a top member made of a plastic material which is adapted for resilient engagement with the container to provide good sealing therebetween. A further object of the present invention is to provide a container closure which includes a top member formed of a plastic material and which has resilient locking means for releasably retaining the closure member on a container.

Other objects and advantages of the present invention will become apparent from the following detailed description taken in connection with the accompanying drawings wherein are set forth by way of illustration and example certain embodiments of this invention.

Figure 2:
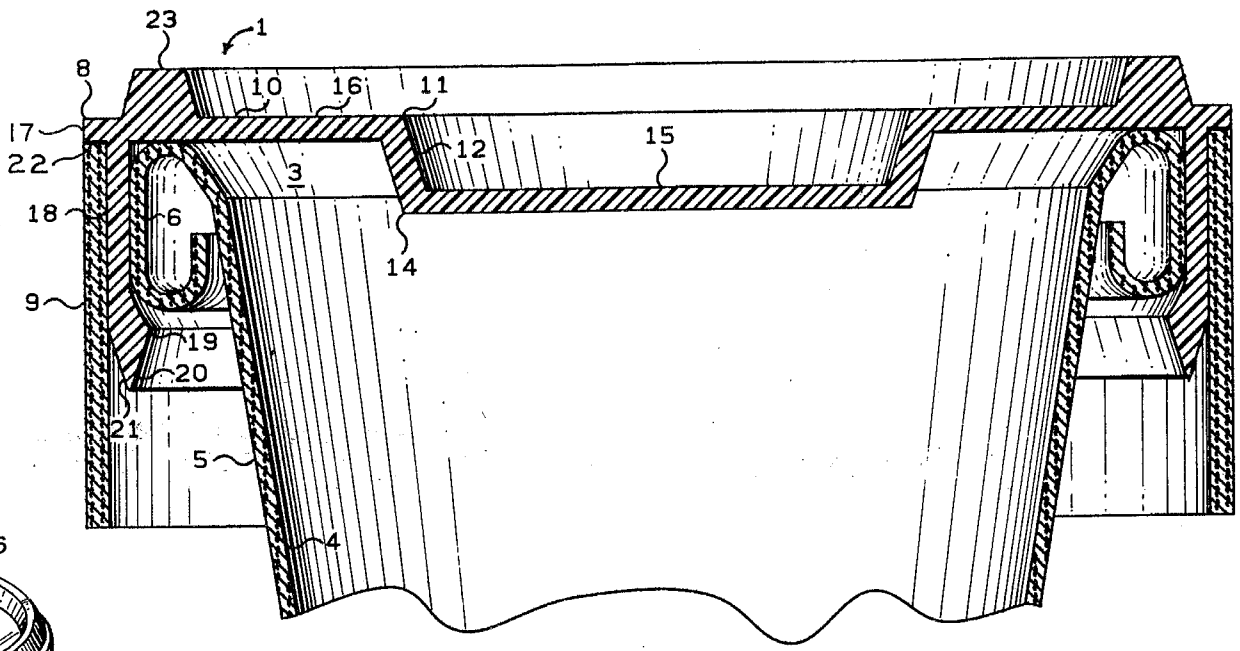
FIG. 2 is an enlarged fragmentary sectional view of a portion of the container and container closure.
Figure 1:
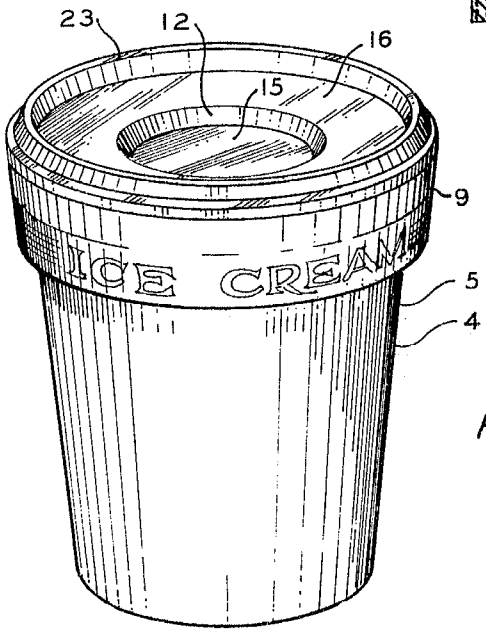
FIG. 1 is a perspective view of a container having a container closure thereon.

The reference numeral 1 designates generally a container closure releasably retained in covering or closing relation to an open end 3 of a container 4. The container 4 can be of any suitable type such as a cylindrical or frustoconical paperboard container having a side wall 5 and an external bead or rim 6 positioned at the upper open end 3. The rim 6 of the illustrated container 4 is rolled outwardly, downwardly and inwardly for approximately 270° to enhance the rigidity of the rim as well as to provide a closure retention surface at the bottom of the rim. Such containers are well known in the art, for example, the container of U.S. Pat. No. 3,369,728.

The closure 1 is a multipiece closure and includes a top member 8 and a ring 9 adapted for display of advertising indicia mounted on the top member 8. The top member 8 can be of any suitable thermoplastic material, for example, polyethylene, polypropylene, polystyrene, etc., and can be made by suitable molding methods, for example, injection molding or thermoforming. Preferably, the top member is of a translucent or transparent material to permit viewing of the contents contained in the container through the top member 8. Structurally, the top member is comprised of a diaphragm and a peripheral skirt. In the illustrated closure the diaphragm comprises 10, 12 and 15. The first portion 10 is a planar panel portion, which is preferably in the shape of an annular ring having an inner edge 11 terminating at the upper edge of downwardly extending tubular portion 12. As illustrated, the tubular portion 12 can be tapered inwardly and downwardly from its upper edge or it can be generally cylindrically shaped. However, for ease of molding of the top, it is preferred that the tubular portion 12 be tapered inwardly and downwardly from the inner periphery of annular portion 10 to a second planar panel portion 15, which is generally circular in shape. The tubular portion 12 and panel 15 cooperate to form a recess in an upper surface 16 of the closure 1. The panel 15 provides a window which can be in engagement with the contents of the container, for example, ice cream, for viewing of the contents in direct contact with the panel 15. However, if the panels 10 and 15 are transparent they would not need to contact the contents for viewing. The panel 10, wall 12 and panel 15 are an integral molded structure.

A depending skirt 18 is positioned radially outwardly of the tubular portion 12 and generally coaxial therewith. Skirt 18 is preferably integral with the panel 10 and is positioned adjacent an outer peripheral edge of the panel 10. The skirt 18 can be any suitable tubular shape, but preferably is generally cylindrical, having an inside diameter of the upper portion of skirt 18 substantially the same size as, and preferably smaller than, the maximum outside diameter of the bead 6 for frictional engagement of bead 6 and skirt 18. The lower portion of the skirt 18 is provided with a locking rib 19 which extends generally radially inwardly from the skirt 18. The rib 19 is spaced downwardly from panel 10 a distance at least slightly greater than the distance between portion 10 and the level of maximum diameter of rim 6 with respect to the longitudinal axis of container 4. This enables the rib 19 to engage the lower curved portion of rim 6. The rib 19 projects inwardly a sufficient distance to present resistance to removal of the closure 1 from the container 2 thereby releasably retaining the closure 1 on the container 2. As shown, the rib 19 is circumferentially continuous, i.e., it extends completely around the skirt 18, but it can be composed of a plurality of segments spaced about the inner periphery of skirt 18. Preferably, the lower disposed portion of the skirt 18 has an inner tapering surface 20 and an outer tapering surface 21. The surface 20 extends inwardly and upwardly from the bottom edge of skirt 18 to provide a tapering lead-in to facilitate installing of the closure 1 over the bead 6. The outer tapering surface 21 extends outwardly and upwardly from the bottom edge of skirt 18 to provide a lead-in for installing the ring 9 on the top member 8. A peripheral portion of the top member 8 forms a flange 17 which extends radially outwardly of the skirt 18. A surface 22 of the flange 17 is adjacent the exterior surface of the skirt 18 and forms a shoulder against which an upper edge of the ring 9 can abut to position the ring 9 relative to the skirt 18.

The ring 9 is tubular or annularly shaped and has opposite ends. While the ring 9 can have any suitable height, e.g., equal to, less than or greater than the height of skirt 18, the ring 9 is preferably longer than the length of the skirt 18. Preferably, the ring 9 is generally cylindrical and has an inside diameter sized slightly smaller than the maximum outside diameter of the upper portion of the skirt 18 to provide frictional engagement therebetween. The frictional engagement between the ring 9 and skirt 18 can be the means for mounting the ring 9 on the top member 8. However, in a preferred embodiment, the ring 9 is adhesively bonded to the skirt 18 to provide permanent securement of the ring 9 to the skirt 18. Preferably, the skirt 9 is of a paperboard material or any other suitable type of material adapted for the printing of indicia thereon. The exterior cylindrical surface of the ring 9 has the indicia imprinted thereon while the interior cylindrical surface of the ring 9 is in engagement with the outer surface of the skirt 18. The ring 9 is mounted on the outside of the skirt 18 to conceal the skirt 18 so as to permit the closure 1 to be retained on the container 4 and permit viewing of the indicia on the ring 9.

In the illustrated structure the top member 8 has an annular protuberance or rib 23 projecting upwardly from portion 10 located radially outwardly of the wall 12. The use of the rib 23 provides for positive stacking of one container on top of another and respective closure. This can be accomplished by providing that the inside diameter of the rib 23 is only slightly larger than the outside diameter of the bottom of the container 4, whereby the bottom of an upper container 4 can be set inside of the rib 23 of the closure on the lower container to prevent relative movement between the thus stacked containers. Also, it is preferred that the rib 23 be an integral molded part of the top member 8.

It is to be understood that while there has been illustrated and described certain forms of this invention, is is not to be limited to the specific form or arrangement of parts herein described and shown.

That which is claimed is:

1. A container closure comprising: a top member having a top forming portion and a generally tubular skirt integral with and depending from said top forming portion, said skirt having an interior surface, an exterior surface and a bottom edge, the exterior surface of the skirt having an upper portion and a lower portion with the upper portion of the exterior surface of the skirt having a generally annular flange integral with and projecting generally radially outward from the upper portion, and the lower portion of the exterior surface of the skirt tapering generally inwardly and downwardly to the bottom edge of the skirt to form a ring lead in, the interior surface of the skirt tapering inwardly and upwardly from the bottom edge of the skirt forming a lead in for installation of said top member on a container and extending to a locking rib projecting generally radially inward from the interior surface of the skirt; and a generally tubular ring having opposite open ends and an interior surface and an exterior surface, with one end of said ring abutting said annular flange and a portion of the interior surface of the ring in engagement with the upper portion of the exterior surface of the skirt said generally tubular ring being made as a part separate from said top member.

2. A container closure as in claim 1 wherein said ring conceals the exterior of said skirt below said annular flange.

3. A container closure as in claim 2 wherein said ring is formed from a paperboard material.

4. A container closure as in claim 3 wherein said top forming portion has a first generally planar portion with an integral generally tubular wall portion depending therefrom at a position radially inwardly of said skirt and having a second generally planar portion integral with said wall portion and extending across a lower end portion of the wall portion, said wall portion and said second generally planar portion forming a recess in a top surface of the top member.

5. A container closure as in claim 4 further comprising a generally annular protuberance integral with said top member and projecting from said top member top surface, said protuberance being positioned radially outwardly of said wall portion.

6. A container closure as in claim 5 wherein said top member is molded and is of a generally translucent or transparent material and said ring has indicia printed on the exterior surface thereof.

* * * * *